US008537105B2

(12) United States Patent
Chiu et al.

(10) Patent No.: US 8,537,105 B2
(45) Date of Patent: Sep. 17, 2013

(54) ELECTRO-PHORETIC DISPLAY APPARATUS

(75) Inventors: Wen-Pin Chiu, Taoyuan County (TW); Chun-An Wei, New Taipei (TW); Ping-Yueh Cheng, Taoyuan County (TW); Feng-Shou Lin, Tainan (TW)

(73) Assignee: SiPix Technology Inc., Taoyuan County (TW)

( * ) Notice: Subject to any disclaimer, the term of this patent is extended or adjusted under 35 U.S.C. 154(b) by 0 days.

(21) Appl. No.: 13/226,501

(22) Filed: Sep. 7, 2011

(65) Prior Publication Data

US 2012/0099180 A1 Apr. 26, 2012

(30) Foreign Application Priority Data

Oct. 21, 2010 (TW) ..... 99136006 A

(51) Int. Cl.
*G09G 3/34* (2006.01)

(52) U.S. Cl.
USPC ..... 345/107

(58) Field of Classification Search
USPC ..... 359/296; 345/107, 204, 211, 690
See application file for complete search history.

(56) References Cited

U.S. PATENT DOCUMENTS 6,961,047 B2 * 11/2005 Katase ..... 345/107
8,264,454 B2 * 9/2012 Kim et al. ..... 345/107

FOREIGN PATENT DOCUMENTS

| | | |
|---|---|---|
| TW | 337576 | 8/1998 |
| TW | 554324 | 9/2003 |
| TW | I245244 | 12/2005 |
| TW | 200828236 | 7/2008 |
| TW | 200926128 | 6/2009 |
| TW | 201001037 | 1/2010 |

OTHER PUBLICATIONS

"Office Action of Taiwan Counterpart Application", issued on Feb. 27, 2013, p. 1-p. 4, in which the listed references were cited.

* cited by examiner

*Primary Examiner* — Tuyen Tra
(74) *Attorney, Agent, or Firm* — Jianq Chyun IP Office

(57) ABSTRACT

An electro-phoretic display apparatus is disclosed. The electro-phoretic display apparatus mentioned above includes a plurality of pixel unit lines, a plurality of common voltage transferring lines, and a common voltage generator. The common voltage transferring lines extend and connect to a common line segment directly along a layout direction. The common voltage generator generates a common voltage and provides the common voltage for directly electrically connecting to a connection point on the common line segment. Moreover, the transfer timing delays of transferring the common voltage from the connection point to the first common voltage transferring line and the last common voltage transferring line are the same.

5 Claims, 4 Drawing Sheets

ELECTRO-PHORETIC DISPLAY APPARATUS

CROSS-REFERENCE TO RELATED APPLICATION

This application claims the priority benefit of Taiwan application serial no. 99136006, filed Oct. 21, 2010. The entirety of the above-mentioned patent application is hereby incorporated by reference herein and made a part of this specification.

BACKGROUND OF THE INVENTION

1. Field of the Invention

The invention generally relates to an electro-phoretic display apparatus.

2. Description of Related Art

With the increasing advancements in electronic technologies nowadays, the electronic paper has emerged as a next generational product popular for enabling a user to have a convenient reading experience. By using electronic paper technology, people no longer have to carry heavy and voluminous books or magazines in order to peruse a large quantity of information. Among the electronic paper technologies, the electro-phoretic display apparatus is a common and popular implementation.

Please refer to FIG. 1, which schematically illustrates a conventional electro-phoretic display apparatus 100. The electro-phoretic display apparatus 100 includes a plurality of pixel units 110-140, and the pixel units are arranged in an array between the scan lines GL1-GL4 and the data lines DL1-DL5. The scan lines GL1-GL4 and the data lines DL1-DL5 are arranged perpendicular to each other. In addition to being connected to the corresponding scan lines and data lines, the pixel units 110-140 respectively receives an alternating current (AC) common voltage VCOM through the transferring lines TL1-TL4 and TA1. On a panel layout of the conventional electro-phoretic display apparatus 100 where the pixel units 110 and 120 are connected to the first scan line GL1, only the common voltage VCOM correspondingly connected to the pixel units 110 and 120 is directly connected to a power source device (not drawn) providing the common voltage VCOM. On the other hand, the pixel units 130-140 connected to other scan lines GL2 and GL4 are connected with the power source device through a transparent conductive film (e.g., an indium tin oxide (ITO) film) from a farther distance. Accordingly, timing delays exist between the common voltage VCOM connected to the pixel units on each of the scan lines.

Please refer to FIG. 2, which illustrates a relational diagram of a pixel voltage of a pixel unit and the common voltage of the conventional electro-phoretic display apparatus. The pixel voltage on the pixel units of the first line Line1 is synchronous with the common voltage VCOM, and the pixel voltage on the pixel units of the last line LineN has a timing delay with the common voltage VCOM, such as the timing delay shown in a region D1 (when the display image remains the same). Moreover, since a turn on time tON and a turn off time tOFF for the electro-phoretic display apparatus are not the same, after successive appearances of the timing differences in the region D1, an image fading phenomenon is generated.

SUMMARY OF THE INVENTION

Accordingly, the invention is directed to an electro-phoretic display apparatus capable of effectively lowering the image fading phenomenon generated due to the delays of different pixel unit lines receiving the common voltage.

An embodiment of the invention provides an electro-phoretic display apparatus, including a plurality of pixel unit lines, a plurality of common voltage transferring lines, and a common voltage generator. The common voltage transferring lines respectively connects to the pixel unit lines, and the common voltage transferring lines extend and connect to a common line segment directly along a layout direction. The common voltage generator generates an alternating current (AC) common voltage, and provides the common voltage for directly electrically connecting to a connection point on the common line segment. Moreover, the transfer timing delays of transferring the common voltage from the connection point to the first common voltage transferring line and the last common voltage transferring line are the same.

According to an embodiment of the invention, the connection point is a center point of the common line segment.

According to an embodiment of the invention, the common voltage transferring lines are formed by using a transparent conductive film such as indium tin oxide (ITO).

According to an embodiment of the invention, each of the pixel unit lines includes a plurality of pixel units.

According to an embodiment of the invention, each of the pixel units includes a thin film transistor, a storage capacitor, and a display capacitor. The thin film transistor has a control terminal connected to a scan line, and a first terminal connected to a data line. The storage capacitor is serially connected between a second terminal of the thin film transistor and one of the common voltage transferring lines. The display capacitor is parallel connected with the storage capacitor.

In summary, according to an embodiment of the invention, the common voltage is directly provided to the pixel unit line disposed at the center of the layout, and the common voltage is transferred to different pixel unit lines through a plurality of common voltage transferring lines. Accordingly, the delay of the common voltage received by each of the pixel unit lines is evenly distributed, thereby effectively lowering the generation of the image fading phenomenon.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 3:
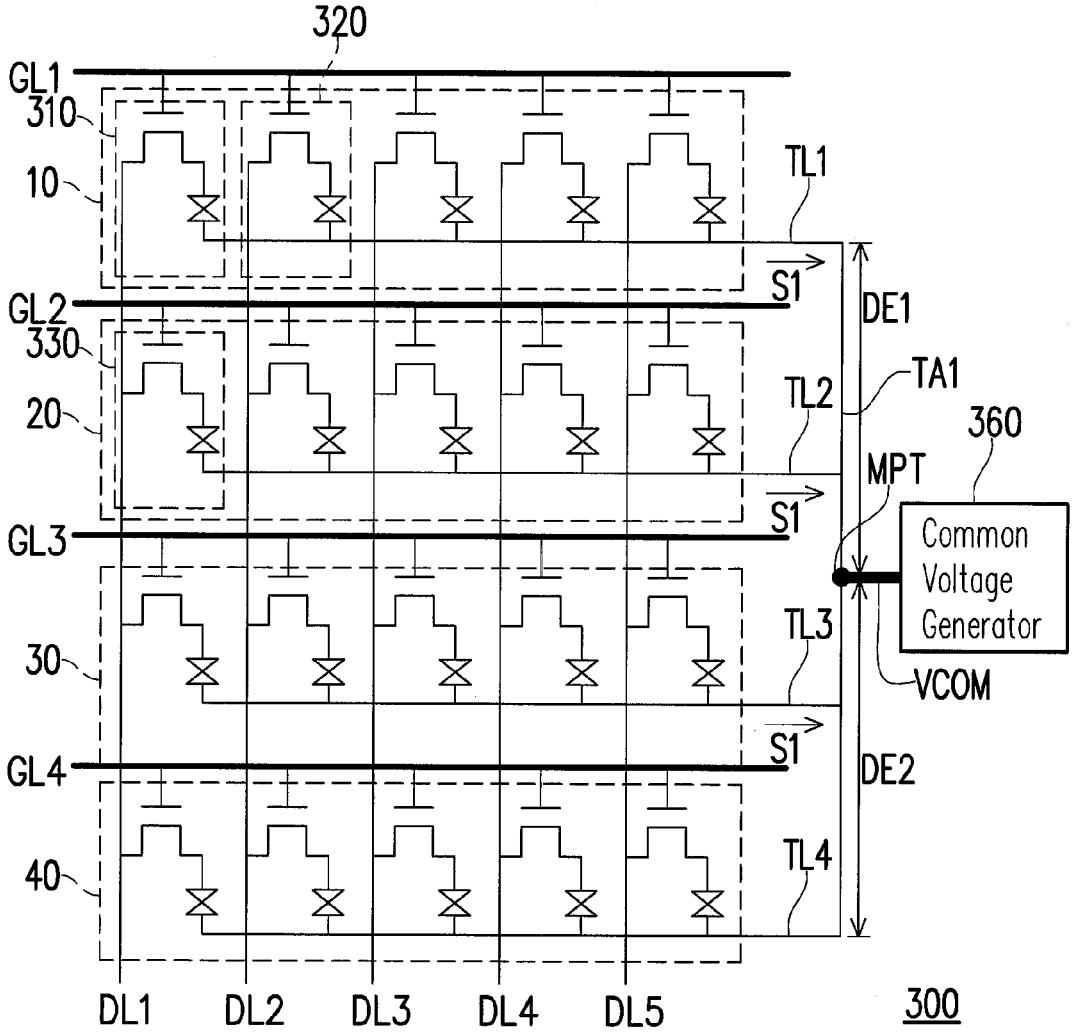
FIG. 3 is a schematic view of an electro-phoretic display apparatus according to an embodiment of the invention.

Please refer to FIG. 3, which is a schematic view of an electro-phoretic display apparatus 300 according to an embodiment of the invention. The electro-phoretic display apparatus 300 includes a plurality of pixel unit lines 10-40, a plurality of common voltage transferring lines TL1-TL4, a common line segment TA1, and a common voltage generator 360. The pixel unit lines 10-40 respectively includes a plurality of pixel units. (e.g., using the pixel unit line 10 for example, the pixel unit line 10 includes pixel units 310-320, etc.) The common voltage transferring lines TL1-TL4 are respectively connected to the pixel unit lines 10-40 and used for transferring an alternating current (AC) common voltage VCOM. The pixel unit lines 10-40 are respectively connected to the scan lines GL1-GL4 and jointly connected to the data lines DL1-DL5. The data lines DL1-DL5 are respectively connected to each of the pixel units (e.g., pixel units 310-330) in each of the pixel unit lines 10-40.

Moreover, the common voltage transferring lines TL1-TL4 extend and connect to the common line segment TA1 directly along a layout direction TA1. Moreover, the common line segment TA1 may also be used as a conductive transferring line to transfer the common voltage VCOM.

The common voltage generator 360 is used for generating the common voltage VCOM. Moreover, the common voltage generator 360 provides the common voltage VCOM for directly electrically connecting to a connection point MPT on the common line segment TA1.

It should be noted that, the afore-described common voltage transferring lines TL1-TL4 and the common line segment TA1 may be formed by using transparent conductive film materials, such that a display aperture ratio of the electro-phoretic display apparatus 300 is not affected, and the common voltage VCOM is effectively transferred. Therefore, the common voltage transferring lines TL1-TL4 and the common line segment TA1 have a non-negligible resistance value thereon. In other words, when the common voltage VCOM is being transferred on the common voltage transferring lines TL1-TL4 and the common line segment TA1, a specific degree of timing delay occurs due to the resistance values thereon.

The connection point MPT is chosen so that a transferring timing delay DE1 needed for transferring the common voltage VCOM from the connection point MPT to the first common voltage transferring line TL1 can be the same as a transferring timing delay DE2 needed for transferring the common voltage VCOM from the connection point MPT to the last common voltage transferring line TL4. Under the condition that the resistance values provided by each unit length of the common line segment TA1 are the same (e.g., in other words, the common line segment TA1 is a transferring line having uniform width and density), the connection point MPT is equal to a center point of the common line segment TA1.

From another perspective, when the common line segment TA1 is not a transferring line having uniform width and density, then the resistance values provided by each unit length of the common line segment TA1 are not the same. Accordingly, the connection point may not be chosen at the center point of the common line segment TA1. Rather, the most suitable connection point MPT may be obtained according a practical calculation, such that the transfer timing delays of transferring the common voltage VCOM from the connection point MPT to the first common voltage transferring line TL1 and the last common voltage transferring line TL4 are the same.

The common line segment TA1 according to the present embodiment of the invention does not necessarily have to be a straight line as illustrated by FIG. 3. The common line segment TA1 may also be bent according to a layout requirement of the display panel of the electro-phoretic display apparatus 300, with emphasis on the common voltage VCOM being directly provided to the connection point MPT matching the above description.

Moreover, the common voltage generator 360 is used to generate the common voltage VCOM. Since the common voltage generator 360 of the present embodiment generates an AC common voltage VCOM, therefore, the common voltage generator 360 must rely on the scan timing of the electro-phoretic display apparatus 300 to provide a transition point of the common voltage VCOM. The implementation details of the common voltage generator 360 are well known to persons having ordinary skills in the art, and thus the description thereof are omitted herein.

Figure 3A:
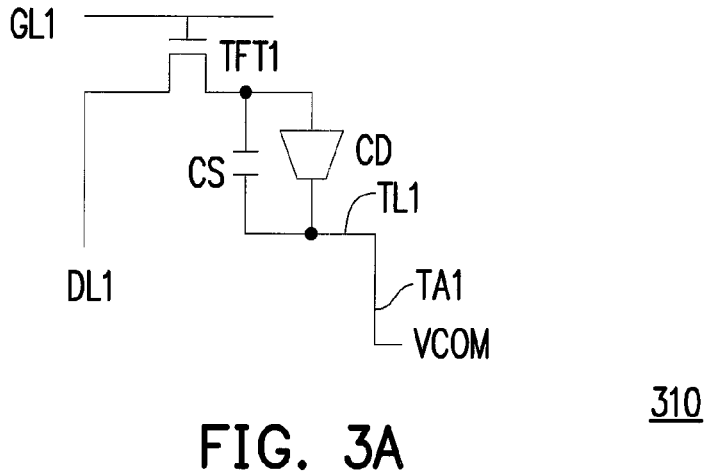
FIG. 3A is a schematic view of a pixel unit according to an embodiment of the invention.

Please refer to FIG. 3A, which is a schematic view of the pixel unit 310 according to an embodiment of the invention. The pixel unit 310 includes a thin film transistor TFT1, a storage capacitor CS, and a display capacitor CD. The thin film transistor TFT1 has a control terminal connected to the scan line G1, and a first terminal connected to the data line DL1. The storage capacitor CS is serially connected between a second terminal of the thin film transistor TFT1 and the common voltage transferring line TL1. The display capacitor CD is parallel connected with the storage capacitor CS.

Figure 1:
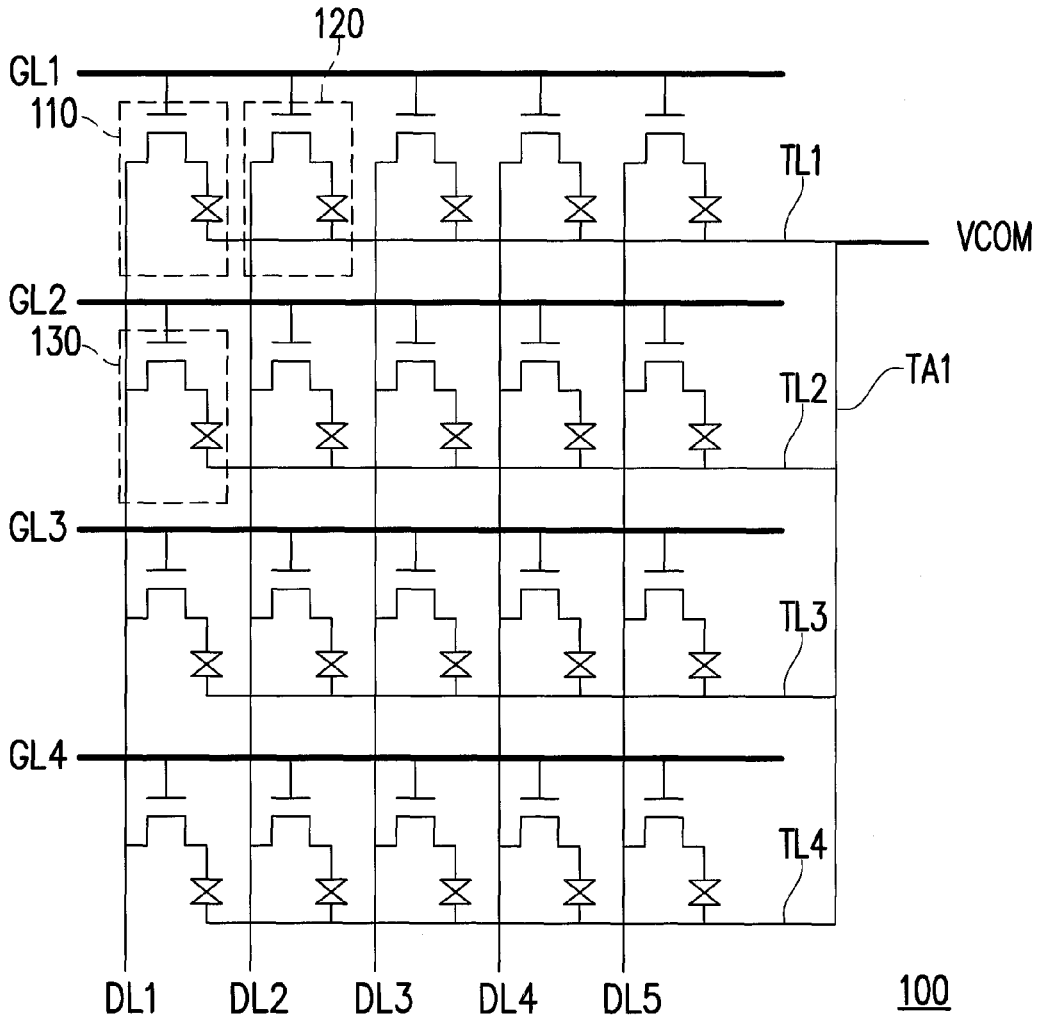
FIG. 1 (RELATED ART)
FIG. 1 is a schematic view of a conventional electro-phoretic display apparatus.
Figure 2:
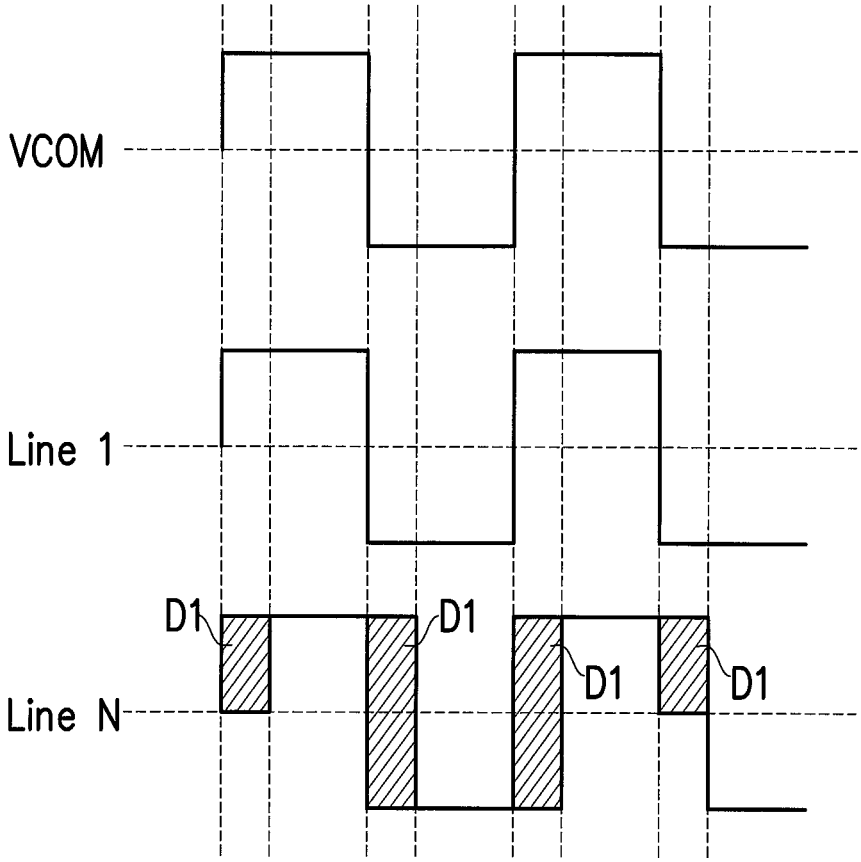
FIG. 2 (RELATED ART)
FIG. 2 is a relational diagram of a pixel voltage of a pixel unit and a common voltage of the conventional electro-phoretic display apparatus.
Figure 4:
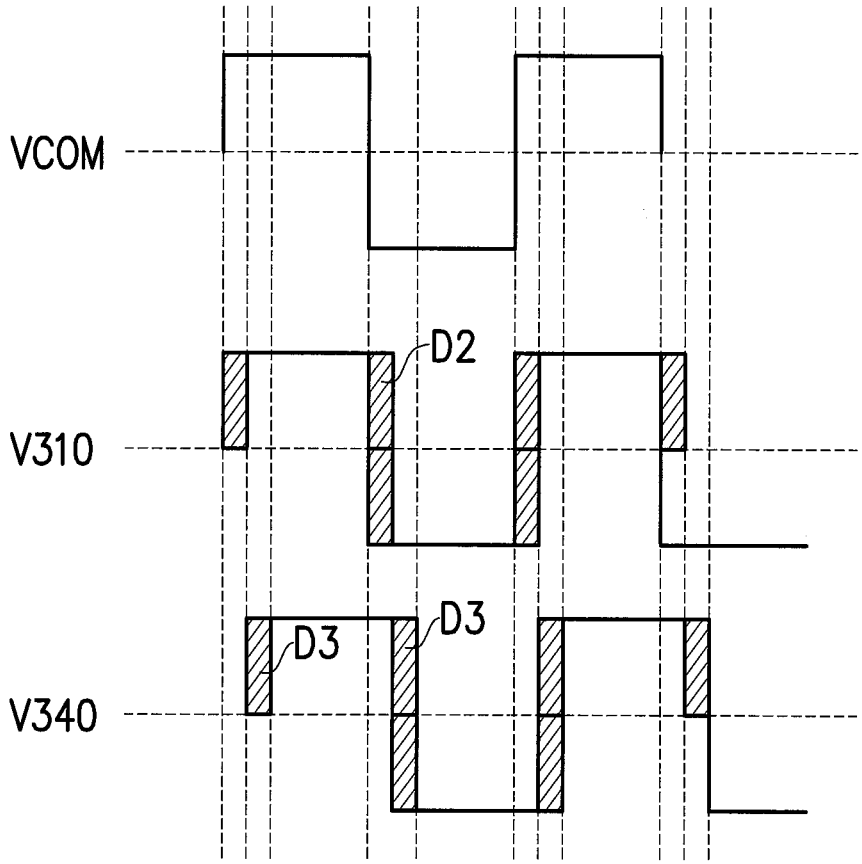
FIG. 4 is a waveform diagram of an electro-phoretic display apparatus according to an embodiment of the invention.

Please refer to FIG. 4, which is a waveform diagram of the electro-phoretic display apparatus 300 according to an embodiment of the invention. Since the common voltage VCOM is directly provided to the connection point MPT, where the transfer timing delays of transferring the common voltage VCOM from the connection point MPT to the first common voltage transferring line TL1 and the last common voltage transferring line TL4 are the same, therefore, the AC common voltage VCOM is evenly distributed on each of the pixel unit lines 310-340 due to the timing delays generated in transfer. The magnitude of a region D2 of the timing delay D2 of a pixel voltage V310 on the pixel unit line 310 and the common voltage VCOM is the same as the magnitude of a region D3 of the timing delay D3 of a pixel voltage V340 on the pixel unit line 340 and the common voltage VCOM. Moreover, the magnitude of the regions D2 and D3 is half of the region D1 depicted in FIG. 2.

In view of the foregoing, according to an embodiment of the invention, the common voltage is directly provided to the connection point, where the transfer timing delays of transferring the common voltage from the connection point to the first common voltage transferring line and the last common voltage transferring line are the same. Accordingly, the AC common voltage is evenly distributed to each of the pixel unit lines due to the transfer timing delays generated on each of the transferring lines, thereby effectively reducing the effect the transfer timing delays have on the electro-phoretic display apparatus, and further lowering the occurrence of an image fading phenomenon.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. An electro-phoretic display apparatus, comprising:

a plurality of pixel unit lines;

a plurality of common voltage transferring lines respectively connected to the pixel unit lines, the common voltage transferring lines extending and connecting to a common line segment directly along a layout direction; and a common voltage generator, directly electrically connected to a connection point on the common line segment for generating an alternating current (AC) common voltage and providing the common voltage to the connection point, wherein a plurality of transfer timing delays of transferring the common voltage from the connection point to the first common voltage transferring line and the last common voltage transferring line of the plurality of common voltage transferring lines are the same.

2. The electro-phoretic display apparatus as claimed in claim 1, wherein the connection point is a center point of the common line segment.

3. The electro-phoretic display apparatus as claimed in claim 1, wherein the plurality of common voltage transferring lines are formed by using a transparent conductive film.

4. The electro-phoretic display apparatus as claimed in claim 1, wherein each of the pixel unit lines comprises a plurality of pixel units.

5. The electro-phoretic display apparatus as claimed in claim 1, wherein each of the pixel units comprises:

a thin film transistor having a control terminal connected to a scan line, and a first terminal connected to a data line;

a storage capacitor serially connected between a second terminal of the thin film transistor and one of the common voltage transferring lines; and a display capacitor parallel connected with the storage capacitor.

* * * * *